United States Patent [19]

Ito

[11] Patent Number: 4,662,296

[45] Date of Patent: May 5, 1987

[54] BUTTONHOLDER FOR ZIGZAG SEWING MACHINE

[75] Inventor: Minoru Ito, Nagoya, Japan

[73] Assignee: Brother Kogyo Kabushiki Kaisha, Nagoya, Japan

[21] Appl. No.: 890,538

[22] Filed: Jul. 24, 1986

[30] Foreign Application Priority Data

Jul. 31, 1985 [JP] Japan ..... 60-117550[U]

[51] Int. Cl.[4] ..... D05B 3/06

[52] U.S. Cl. ..... 112/449

[58] Field of Search ..... 112/449, 448, 446, 459, 112/460, 461, 462, 463, 464, 465, 466, 447

[56] References Cited

U.S. PATENT DOCUMENTS 3,479,977 11/1969 Meier ..... 112/449 X 4,577,575 3/1986 Stevens et al. ..... 112/449

*Primary Examiner*—Peter Nerbun

*Attorney, Agent, or Firm*—Cushman, Darby & Cushman

[57] ABSTRACT

A buttonholer for forming hemstitches along the opposite legs of a buttonhole and bar tacks at the opposite ends of the same. A buttonholing feed regulating plate is mounted slidably on a feed control cam having a uniform lift cam surface formed in the circumference thereof, and the position of the buttonholing feed regulating plate relative to the feed control cam is decided by means of a buttonholing feed regulating cam to set a feed amount of the feed dog for hemstitching the legs of a buttonhole. An actuator plate is mounted slidably on a lateral jogging control cam having a cam surface formed in the circumference thereof, and the position of the actuator plate relative to the lateral jogging control cam is decided by means of a hemstitching groove cam which is driven by the main shaft of the sewing machine. The lateral oscillation of the needle of the sewing machine in forming hemstitches along the legs of the buttonhole and the lateral oscillation of the same in forming bar tacks at the opposite ends of the buttonhole are set by the engagement of a finger with the cam surface of the lateral jogging control cam and with the end of the actuator plate, respectively.

5 Claims, 6 Drawing Figures

BUTTONHOLDER FOR ZIGZAG SEWING MACHINE

BACKGROUND OF THE INVENTION

The present invention relates to an automatic buttonholer for a zigzag sewing machine.

The control machanism, particularly, the feed control mechanism, of a conventional buttonholer disclosed in Japanese Patent Publication (TOKU-KAI-SHO) No. 57-64086 has a feed control cam for controlling material feed direction in stitching bar tacks at the opposite ends of a buttonhole and in stitching overcast stitches along the opposite legs of the buttonhole, and a feed regulating cam for regulating the direction and the amount of a feed motion. The feed regulating cam has a cam groove. The inner wall surface of the cam groove serves as a forward feed regulating cam surface by which forward feed amount is reduced according to the height of the cam surface, a central cam surface for zero feed and an outer wall surface serving as backward feed regulating cam surface by which backward feed amount is increased according to the height of the cam surface. The position of a pin attached to a first contact arm is changed between positions corresponding to the inner wall surface, the central cam surface and the outer wall surface of the cam groove by controlling the first contact arm with a feed control cam. A second contact arm having a contact-part contacting the feed control cam is necessary for controlling the position of the pin attached to the first contact arm. This feed control mechanism of the conventional buttonholer further needs many other parts, as parts for pivotally supporting the first and second contact arms, an extension spring having one end connected to the first contact arm and the other end connected to the second contact arm so as to bias the first and second contact arms toward each other, extension springs for rotatably biasing the first and second contact arms and many parts for interlocking these many parts. Accordingly, the feed control mechanism has problems that constructing the mechanism with high accuracy is difficult, the mechanism is inevitably large in size and the mechanism requires high manufacturing cost.

SUMMARY OF THE INVENTION

The principal object of the present invention is to provide a buttonholer of a simple construction.

Another object of the present invention is to provide a buttonholer having a feed control mechanism comprising the least possible number of members and capable of three modes of feed regulating and control for buttonholing.

In a buttonholer according to the present invention, a feed regulating cam is provided so as to be turned by an operating member provided on the frame of the sewing machine, a pair of feed regulating cam surfaces are formed diametrically on one side surface of the feed regulating cam for regulating the forward and backward feed of the material in stitching the opposite legs of a buttonhole, feed control cam is provided coaxially with the feed regulating cam so as to be rotated about the axis of rotation thereof, and a uniform lift cam surface for setting the feed of a feed dog at zero or at a very small stroke is formed in the circumference of the feed control cam. Clutch means is provided between the main shaft of the sewing machine and the feed control cam to rotate the feed control cam in synchronism with the main shaft and to stop the feed control cam independently of the main shaft according to the progress of buttonholing operation. A sliding member is fitted in a groove formed in one side surface of the feed control cam facing one side surface of the feed regulating cam so as to be slidable across the axis of rotation of the feed control cam. The opposite ends of the sliding member are able to project from the uniform lift cam surface of the feed control cam. A pin as an engaging member is attached fixedly to the sliding member so as to project from the sliding member for selectively engaging a pair of feed regulating cam surfaces formed in the feed regulating cam. A finger as a cam follower is always biased resilliently toward the feed control cam so as to engage each one of the opposite ends of the sliding member, the position of which being regulated by a pair of the feed regulating cam surfaces, or the uniform lift cam surface of the feed control cam. The feed dog of a feed unit is controlled by the finger for forward and backward feed motions for carrying out buttonholing.

In this buttonholer, the sliding member slides relative to the feed control cam as the pin follows the feed regulating cam surface when the feed regulating cam is turned, and thereby the finger engaging the sliding member is shifted to set a feed amount for hemstitching a buttonhole.

As described hereinbefore, in the buttonholer according to the present invention, the feed regulating cam and the feed control cam are interlocked by the sliding member slidably mounted on the side surface of the feed control cam. Accordingly, the feed regulating cam and the feed control cam are interlocked with each other by a very simple mechanism, precise buttonholing operation is achieved through highly accurate feeding motion, the feed control mechanism can be formed in a compact construction, and the buttonholer can be manufactured at a reduced manufacturing cost.

DESCRIPTION OF THE PREFERRED EMBODIMENT

A preferred embodiment of the present invention will be described hereinafter with reference to the accompanying drawings.

Figure 1:
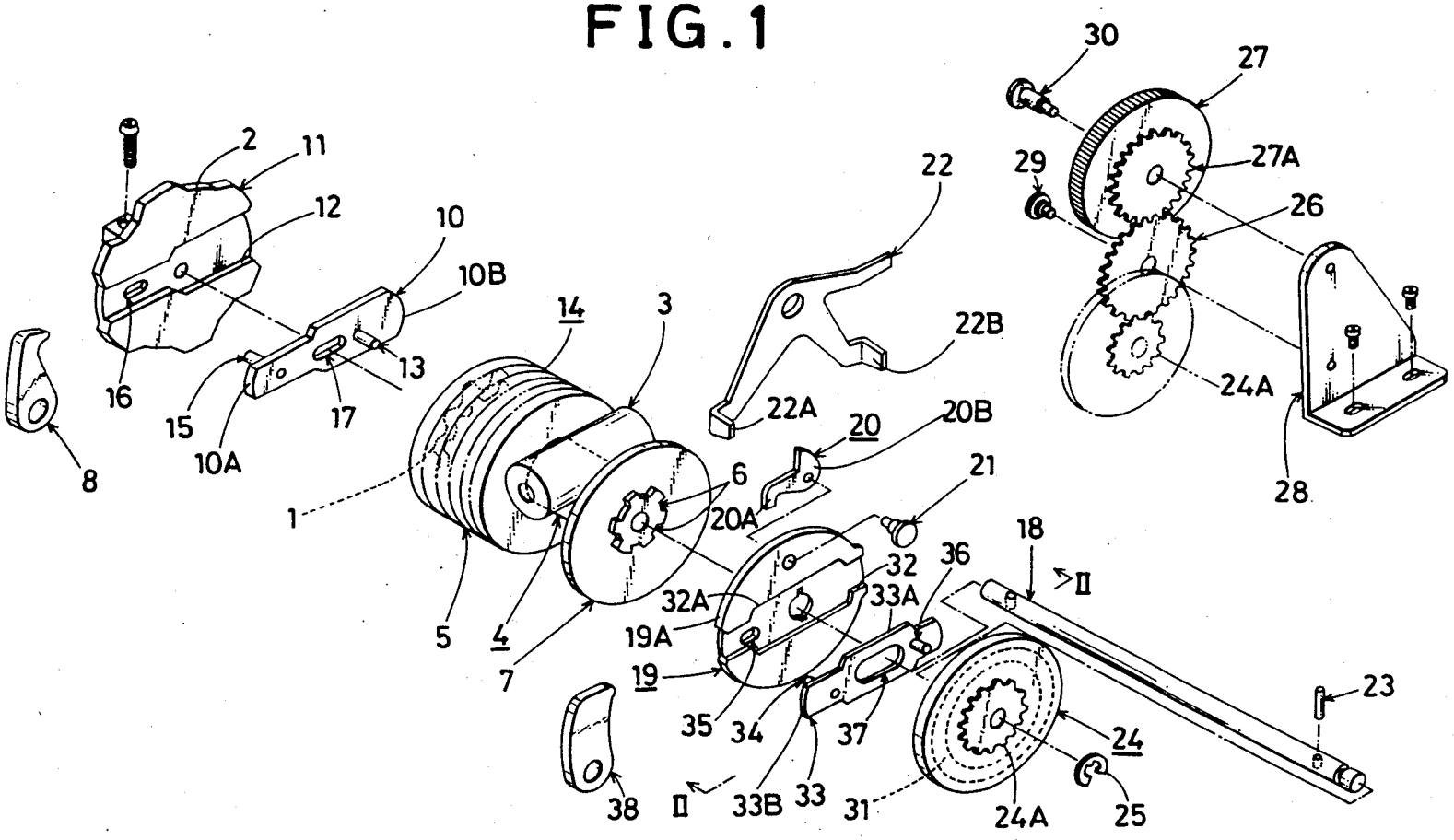
FIG. 1 is an exploded perspective view of a buttonholer, in a preferred embodiment, according to the present invention; and FIGS. *2a* to *2e* are sectional views taken on line II—II in FIG. 1, showing various positions of a feed control cam during different phases of the cycle of operation.

Referring to FIGS. 1 and *2a* to *2e*, a lateral jogging control cam 11 as zigzag control cam is screwed fixedly to one end, the left end, as viewed in FIG. 1, of a cam shaft 18, while a feed control cam 19 is mounted on the other end, the right end, as viewed in FIG. 1, of the cam shaft 18 and is restrained from rotation with a pin 23 engaging the central part of the feed control cam 19 and the cam shaft 18. A uniform lift cam surface 19A is formed in the circumference of the feed control cam 19 to set the feed amount of the feed dog at zero or at a very small feed amount in stitching bar tacks at the opposite ends of a buttonhole. A groove 32 is formed in one side surface of the feed control cam 19. A lateral jogging control cam unit 14 for forming zigzag patterns other then buttonhole stitches and a cam gear 4 secured to the lateral jogging control cam unit 14 are supported for rotation relative to the cam shaft 18 at an intermediate position on the cam shaft 18. The cam gear 4 engages a driving gear 3 fixed to the main shaft, not shown, of the sewing machine for rotation about an axis of rotation perpendicular to the axis of the cam shaft 18. A feed cam 7 for controlling material feeding motion in stitching zigzag patterns other than buttonhole stitches is formed integrally on one side surface of the cam gear 4. A projection having recesses 6 is formed in the side surface of the feed cam 7. Radial cam surface 2 is formed in the circumference of the lateral jogging control cam 11. A groove 12 is formed in the side surface of the lateral jogging control cam 11 across the axis of rotation of the same. An actuator plate 10 for controlling the lateral oscillation of the reciprocatory and laterally joggable needle bar in stitching the legs of a buttonhole, having cam surface formed at the opposite ends 10A and 10B is fitted slidably in the groove 12 with a pin 15 fixed to one side surface thereof received in a slot 16 formed in the lateral jogging control cam 11. A slot 17 is formed in the central portion of the actuator plate 10 to receive the cam shaft 18 therethrough. A pin 13 fixed to the other side surface, the right-hand side surface, as viewed in FIG. 1, of the actuator plate 10 is received between the radially opposite cam surfaces of a groove cam 1 as a zigzag cam for leg stitching formed in the side surface of the lateral jogging control cam unit 14 facing the lateral jogging control cam 11 for buttonholing. Zigzag control cams 5 for forming zigzag patterns other than buttonhole stitches in the fabric are formed in the circumference of the lateral jogging control cam unit 14. A finger 8 is biased so as to engage the zigzag control cam 5 or the cam surface 2 of the lateral jogging control cam 11 and is shiftable. The finger 8 is operatively connected through a known lateral jogging regulating mechanism to the needle bar with a needle attached. A buttonholing feed regulating cam 24 is supported on the right end of the cam shaft 18 so as to be rotatable relative to the cam shaft 18 and is held in place with a snap ring 25. A gear 24A formed in the side surface of the buttonholing feed regulating cam 24 engages an intermediate gear 26 engaging a gear 27A formed in the side surface of a manual operating member, namely, a dial 27. The dial 27 and the intermediate gear 26 are supported rotatably on a bracket 28 fixed to the frame of the sewing machine by stud shafts 30 and 29 fixed to the bracket 28 by caulking. A groove cam 31 is formed in one side surface of the buttonholing feed regulating cam 24. As shown in FIGS. 2*a* to 2*e*, the groove cam 31 has a pair of feed regulating cam surfaces 31A and 31B for regulating the forward feed amount and the backward feed amount of the feed dog. The cam surfaces 31A and 31B are radially opposite to each other.

A clutch pawl 20 is supported pivotally on one side surface of the feed control cam 19 by a pin 21 caulked to the feed control cam 19. The tip 20A of the clutch pawl 20 has a width fitting the recess 6 of the projection formed in the side surface of the feed cam 7. The rear end 20B of the clutch pawl 20 is engageable alternately with the lugs 22A and 22B of a bifurcate pawl control plate 22. The recesses 6, the clutch pawl 20 and the pawl control plate 22 constitute clutch means.

Figure 2:
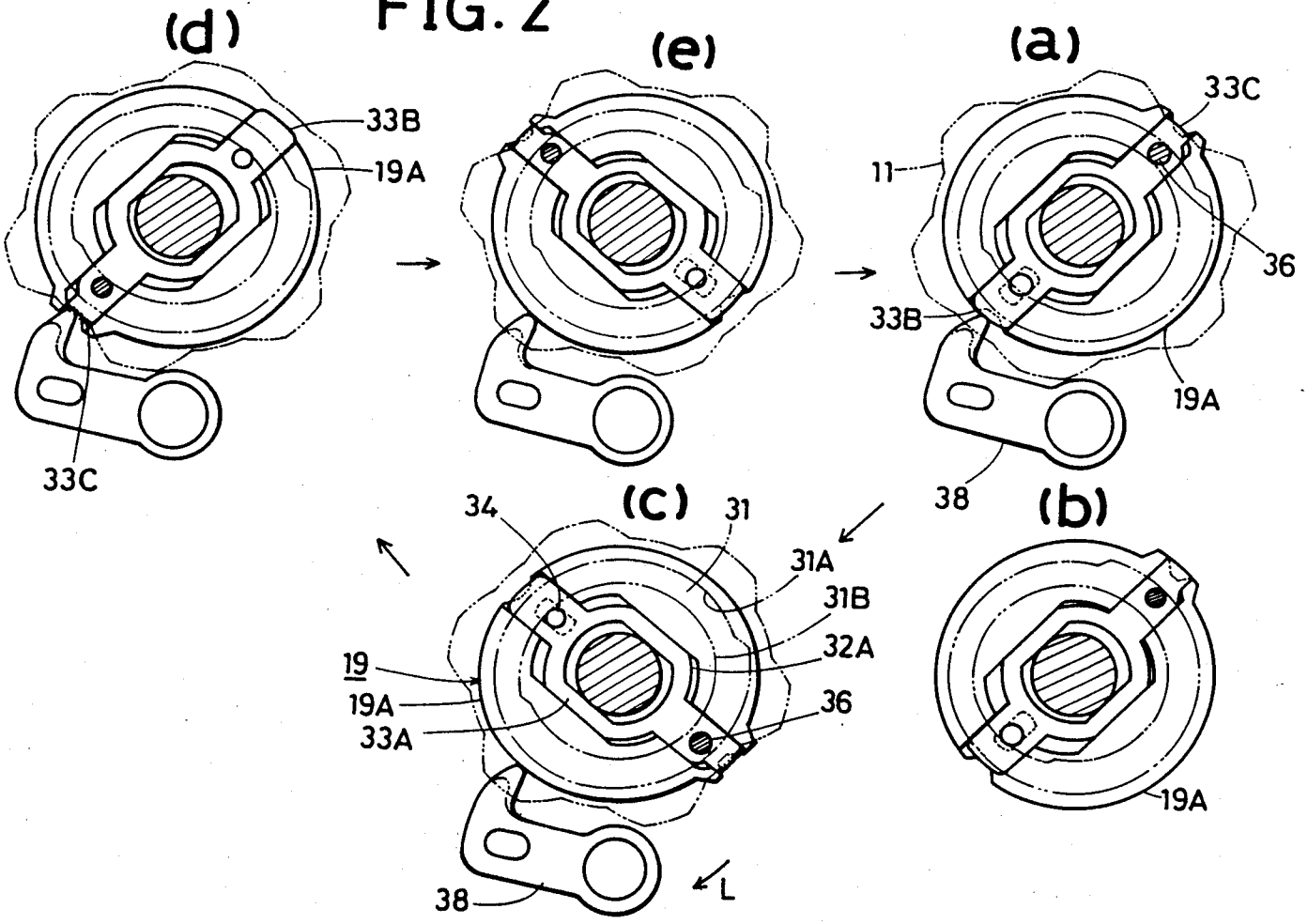

A buttonholing feed regulating plate 33 is fitted slidably in the groove 32 of the feed control cam 19. A pin 34 fixed to and projecting from one side surface of the buttonholing feed regulating plate 33 is received in a slot 35 formed in the feed control cam 19, while a pin 36 fixed to and projecting from the other side surface of the buttonholing feed regulating plate 33 is received in the groove cam 31, namely, between the feed regulating cam surfaces 31A and 31B, of the buttonholing feed regulating cam 24. The cam shaft 18 is received through a slot 37 formed in the central portion of the buttonholing feed regulating plate 33 so that the buttonholing feed regulating plate 33 is movable in directions perpendicular to the axis of the cam shaft 18. The central portion 33A of the buttonholing feed regulating plate 33 is formed substantially in a rectangular shape having a length slightly smaller than the length of the central portion 32A of the groove 32 of the feed control cam 19. As shown in FIG. 2*b*, the front end 33B and the rear end 33C of the buttonholing feed regulating plate 33 are able to project from the uniform lift cam surface 19A of the feed control cam 19.

A finger 38 is connected operatively through a known feed regulating mechanism to the feed dog and is always biased resiliently toward the feed control cam 19 so as to engage the uniform lift cam surface 19A of the feed control cam 19, or the end 33B or 33C of the buttonholing feed regulating plate 33.

The manner of operation of this embodiment will be described hereinafter.

Prior to starting the buttonholing operation, the buttonholing feed regulating cam 24 is adjusted in a desired phase by means of the dial 27. Upon the selection of the buttonholing mode, the fingers 8 and 38 are shifted to positions shown in FIG. 1 and contact the lateral jogging control cam 11 and the feed control cam 19, respectively. When the sewing machine is started, the driving gear 3 is driven by the main shaft of the sewing machine, so that the cam gear 4 and the feed cam 7 are rotated. Since the clutch pawl 20 is caused to engage the recess 6 of the feed cam 7 by the pawl control plate 22, the feed control cam 19, hence the buttonholing feed regulating plate 33, starts rotating together with the feed cam 7 as shown in FIG. 2*c*. The lateral jogging control cam 11 is rotated by the cam shaft 18. On the other hand, the buttonholing feed regulating cam 24 capable of being freely turned relative to the cam shaft 18 remains stationary at the phase selected previously by means of the dial 27. As the finger 8 is caused to sewing by the cam surface 2 of the lateral jogging control cam 11, the needle of the sewing machine is reciprocated laterally at a maximum stroke. Since the finger 38 is in contact with the uniform lift cam surface 19A of the feed control cam 19 as shown in FIG. 2*c*, the feed amount of the feed dog is zero or very small. Thus, a bar tack is formed at one end of a buttonhole as the needle of the sewing machine is reciprocated at the maximum lateral stroke while the material feeding amount of the feed dog is zero or very small.

After the cam shaft 18 has been turned substantially through an angle of 180 degrees from a position shown in FIG. 1, the clutch pawl 20 is turned clockwise by the lug 22A of the pawl control plate 22 to disengage the tip 20A of the clutch pawl 20 from the recess 6, and hence the feed control cam 19 stops and the finger 38 contacts the rear end 33C of the buttonholing feed regulating plate 33 as shown in FIG. 2*d*. In this state, where the feed control cam is stationary, the position of the buttonholing feed regulating plate 33 relative to the feed control cam 19 can be readjusted, if necessary, by operating the dial 27 to turn the buttonholing feed regulating cam 24 to a desired phase through the intermediate gear 24A. Since the finger 38 is in contact with the rear end 33C of the buttonholing feed regulating plate 33, the feed dog is driven through a known feed regulating device for backward feed motion at a desired backward feed amount, and thereby the material is fed backward. On the other hand, since the finger 8 is in contact with the end 10B of the actuator plate 10, the finger 8 is reciprocated at a small stroke as the actuator plate 10 is reciprocated by the zigzag cam surface of the groove cam 1, so that the left leg of the buttonhole is hem-stitched satisfactorily.

After the left leg of the buttonhole having a length corresponding to the size of the button has been hem-stitched, the pawl control plate 22 interlocked with a fabric pressing device, not shown, is turned to allow the tip 20A of the clutch pawl 20 to engage the recess 6. Consequently, the feed control cam 19 starts rotating again and the finger 38 comes into contact with the uniform lift cam surface 19A of the feed control cam 19, and thereby the fabric feed amount is reduced to zero or to a very small value. Furthermore, the lateral jogging control cam 11 is rotated together with the feed control cam 19 by the cam shaft 18, and thereby the finger 8 is reciprocated at the maximum stroke by the cam surface 2 of the lateral jogging control cam 11. Consequently, a bar tack is formed at the other end of the buttonhole as the needle of the sewing machine is reciprocated at the maximum lateral oscillation while the material feeding amount of the feed dog is zero or very small.

After the feed control cam 19 has been turned further through an angle of 180 degrees from the position shown in FIG. 2*d*, the tip 20A of the clutch pawl 20 is disengaged from the recess 6 by the pawl control plate 22 to stop the feed control cam 19. Then, as shown in FIG. 2*a*, the finger 38 contacts the front end 33B of the buttonholing feed regulating plate 33 and the pin 36 contacts the outer feed regulating cam surface 31A. Consequently, the finger 38 is moved to a position determined by the projection of the front end 33B from the circumference of the feed control cam 19, and thereby the fabric is fed forward at a desired feed amount. The lateral jogging control cam 11 is stopped when the feed control cam 19 is stopped. Then, the finger 8 contacts the end 10A of the actuator plate 10. Since the actuator plate 10 is reciprocated in the groove 12 relative to the lateral jogging control cam 11 by the zigzag cam surface of the groove cam 1 of the lateral jogging control cam unit 14, the finger 8 is reciprocated the reciprocate the needle of the sewing machine at a fixed lateral oscillation. Thus, the right leg of the buttonhole is hem-stitched while the fabric is fed forward at a desired feed amount and the needle is oscillated at a desired lateral amount. Thus, the buttonholing operation is completed.

When the pin 36 is in contact with a segment of the outer feed regulating cam surface 31A having the largest radius and the buttonholing feed regulating plate 33 is projected from the uniform lift cam surface 19A of the feed control cam by a maximum distance, the feed dog is driven for forward feed motion at the maximum feed amount.

In this embodiment, the buttonholing feed regulating plate 33 is a flat plate, however, the shape of the buttonholing feed regulating plate 33 need not necessarily be limited thereto, but the buttonholing feed regulating plate 33 may be a curved plate.

What is claimed is:

1. A zigzag sewing maching having a main shaft, a laterally joggable needle bar reciprocatory with the rotation of said main shaft, a feed device for feeding a material to be sewn in a selected one of a forward and a backward feeding direction and an automatic buttonholer operative to produce a buttonhole including a front and a rear bar tacking part and a left and a right leg stitching part, said automatic buttonholer comprising:

a feed regulating cam provided rotatably about a fixed axis to change an angular position according to the operation of an operating member and having a pair of feed regulating cam surfaces for variably setting feed amounts in said forward and backward feeding direction when said left and right leg stitching part are produced, said pair of feeding regulating cam surfaces being formed on one side surface of said feed regulating cam and opposite to each other in a diametrical direction thereof;

a feed control cam provided rotatably about said fixed axis and having a uniform lift cam surface formed in the circumference thereof, said uniform lift cam surface being adapted to set a feed amount when each of said front and rear bar tacking parts is produced;

clutch means disposed between said main shaft and said feed control cam for rotating said feed control cam in synchronism with said main shaft and stopping said feed control cam independently of said main shaft;

a sliding member mounted on one side surface of said feed control cam facing said side surface of said feed regulating cam to be slidable across said fixed axis, said sliding member having opposite ends capable of projecting from said uniform lift cam surface;

an engaging member secured to said sliding member and disposed between said pair of feed regulating cam surfaces to selectively engage with one of said pair of feed regulating cam surfaces;

a cam follower biased resiliently toward said feed control cam and operatively connected with said feed device, said cam follower being arranged to engage with said uniform lift cam surface and said opposite ends of said sliding member in predetermined order during production of said buttonhole.

2. A zigzag sewing machine according to claim 1, wherein a groove is formed on said side surface of said feed regulating cam and said feed regulating cam surfaces comprise an inner and an outer surface of said groove opposite to each other in a diametrical direction of said feed regulating cam.

3. A zigzag sewing machine according to claim 1, wherein said sliding member is slidably received in a groove which is formed on said side surface of said feed control cam facing said side surface of said feed regulating cam.

4. A zigzag sewing machine according to claim 1, wherein said clutch means is provided on the other side surface of said feed control cam.

5. A zigzag sewing machine having a main shaft, a laterally joggable needle bar reciprocatory with the rotation of said main shaft, a feed device for feeding a material to be sewn in a selected one of a forward and a backward feeding direction and an automatic buttonholer operative to produce a buttonhole including a front and a rear bar tacking part and a left and a right leg stitching part, said automatic buttonholer comprising:

a zigzag cam provided to rotate about a fixed axis in association with the rotation of said main shaft and having a pair of zigzag cam surfaces for generating lateral jogging motions of said needle bar when said left and right stitching part are produced, said pair of zigzag cam surfaces being formed on one side surface of said zigzag cam and oppostie to each other in a diametrical direction thereof;

a zigzag control cam provided rotatably about said fixed axis and having a radial cam surface formed in the circumference thereof, said radial cam surface being adapted to generate a lateral jogging motion when each of said front and rear bar tacking parts is produced;

clutch means disposed between said main shaft and said zigzag control cam for rotating said zigzag control cam in synchronism with said zigzag cam and stopping said zigzag control cam independently of said zigzag cam;

a sliding member mounted on one side surface of said zigzag control cam facing said side surface of said zigzag cam to be slidable across said fixed axis, said sliding member having opposite ends capable of projecting from said radial cam surface;

an engaging member secured to said sliding member and disposed between said pair of zigzag cam surfaces to selectively engage with one of said pair of zigzag cam surfaces;

a cam follower biased resiliently toward said zigzag control cam and operatively connected with said needle bar, said cam follower being arranged to engage with said radial cam surface and said opposite ends of said sliding member in predetermined order during production of said buttonhole.

* * * * *